United States Patent [19]

Greenquist

[11] Patent Number: 4,736,544

[45] Date of Patent: Apr. 12, 1988

[54] BLADE HOLDER FOR SHARPENING LAWNMOWER BLADES

[76] Inventor: Lawrence Greenquist, Rte. 1, Box 402, Fergus Falls, Minn. 56537

[21] Appl. No.: 44,599

[22] Filed: May 1, 1987

[51] Int. Cl.[4] ..... B24B 3/36

[52] U.S. Cl. ..... 51/34 R; 51/217 A; 51/218 A; 51/221 BS; 76/82.1

[58] Field of Search ..... 51/34 R, 217 R, 217 A, 51/218 R, 218 A, 221 BS, 216 R, 216 A, 36, 241 G; 76/82.1

[56] References Cited

U.S. PATENT DOCUMENTS

| | | | |
|---|---|---|---|
| 155,734 | 10/1874 | Klaber | 51/217 A |
| 1,358,998 | 11/1920 | Stauder | 51/218 R |
| 1,915,247 | 6/1933 | Holloway el al. . | |
| 2,353,891 | 7/1944 | Grundorad | 51/217 R |
| 2,589,165 | 3/1952 | Toy el al. | 76/40 |
| 2,644,279 | 7/1953 | Stankovich | 51/218 A |
| 2,888,965 | 6/1959 | Phillips | 144/1 |
| 2,943,423 | 7/1960 | Machovec | 51/218 A |
| 3,054,229 | 9/1962 | Peasley et al. | 51/122 |
| 3,061,980 | 11/1962 | Machovec | 51/48 |
| 3,574,268 | 5/1971 | Buse | 51/92 |
| 4,265,146 | 5/1981 | Horrell | 76/82.1 |
| 4,528,778 | 7/1985 | Wolff | 51/91 |

*Primary Examiner*—Frederick R. Schmidt
*Assistant Examiner*—Robert A. Rose
*Attorney, Agent, or Firm*—Kinney & Lange

[57] ABSTRACT

A rotary grinder is mounted on a flat top bench to have a grinding wheel rotating on a horizontal axis. A blade holder for sharpening lawnmower blades has a slotted face bar pivotally mounted to a forward portion of a horizontal base plate resting on the bench top. A pair of upright legs extend upwardly from a rear portion of the base plate. A lawnmower blade is mounted to the face bar on a bolt extending through the face bar slot and the blade to have one of its cutting edges lying in a horizontal plane coincident with the grinding wheel axis. A blade positioning bar is mounted in the face bar slot and clamped up against the bottom edge of the blade. The angle of the face bar is set and the face bar clamped to the legs. The one cutting edge of the blade is sharpened by sliding the holder on the bench top to move the cutting edge into the grinding wheel. The blade is rotated end for end and reclamped to sharpen the other cutting edge.

10 Claims, 1 Drawing Sheet

BLADE HOLDER FOR SHARPENING LAWNMOWER BLADES

BACKGROUND OF THE INVENTION

1. Field of the Invention

This invention has relation to a jig for holding rotary lawnmower blades for sharpening.

2. Description of the Prior Art

It is known to provide an adjustable blade holder that pivots about a guide rod to provide a desired bevel angle for sharpening a blade. See U.S. Pat. No. 3,574,268 issued to Buse in April of 1971.

Other devices for sharpening lawnmower blades are found in the following patents which do not show the claimed features of the present invention. U.S. Pat. No. 4,265,146 issued to Horrell in May of 1981; and U.S. Pat. No. 3,061,980 issued to Machovec in November of 1962.

What was needed before the present invention was a blade holder which could produce precisely angled cutting edge portions on lawnmower blades and then could produce identically beveled cutting edges on identically shaped cutting edge portions symmetrically situated at opposite ends of rotary lawnmower blades.

Additional patents found in a search for this invention show structures for grinding other implements, but none provide for precisely positioning and repositioning the blade to be ground symmetrically at both ends. These patents are:

| U.S. Pat. No. | Inventor | Issued |
|---|---|---|
| 4,528,778 | Wolff | July 1985 |
| 3.054,229 | Peasley et al. | September 1962 |
| 2,888,965 | Phillips | June 1959 |
| 2,589,165 | Toy et al. | March 1952 |
| 1,915,247 | Holloway et al. | June 1933 |

SUMMARY OF THE INVENTION

A blade holder of the invention is for use with a grinder which is fixedly mounted relative to a horizontal surface and has an abrasive wheel rotating on a horizontal axis.

In a broad form, such a blade holder can include a base plate positioned for slidable movement over a horizontal surface, a bar pivotally mounted at its lower end with respect to the base plate, and support means extending upwardly from the base plate in position to receive a portion of the bar and for supporting the bar in a fixed angular position to the base plate. Means is also provided to clamp a blade to be sharpened against the bar in a fixed position.

The blade holder is particularly useful for sharpening an elongate lawnmower blade having a relatively flat central portion provided with a mounting bolt receiving opening therethrough and having a pair of cutting edge portions providing a pair of cutting edges, the cutting edge portions intended to be symmetrical about a center blade axis normal to the flat plane of the central portion and concentric with the bolt opening.

In the form of the invention as shown, the blade holder includes a base plate positioned for slidable horizontal movement over the horizontal bench surface; a flat, elongate face bar partially defined by an upper, plane, blade-receiving surface and pivotally mounted on a horizontal axis to a front edge portion of the base plate to be positionable so as to locate its blade-receiving surface in any desired acute angular position with respect to the base plate over a predetermined range of angular movement of the face bar. The blade holder also includes upright leg means or support means extending upwardly from a rear edge portion of the base plate to be in aligned relation adjacent the face bar throughout a predetermined range of angular movement of the face bar. Blade clamping means is provided for clamping a center portion of a lawnmower blade to be sharpended to the face bar to have the cutting edge of one of its cutting edge portions lying in a horizontal plane coincident with the horizontal grinding wheel axis when the base plate is positioned above the horizontal bench surface, so as to have such cutting edge lying in a horizontal plane very closely adjacent and parallel to a horizontal plane coincident with the grinding wheel axis.

Releasable face bar clamping means is provided which is cooperable with the upright leg means to fix the face bar against movement about its horizontal pivot axis when the face bar is supporting the blade so that a desired cutting edge bevel angle will be attained when the base plate is moved over the bench surface to bring the outer periphery of the grinding wheel into contact with the cutting edge portion.

In the form of the invention as shown, the face bar is provided with a longitudinally extending slot therethrough. A blade mounting bolt receiving opening is provided in the center of the blade. The blade clamping means includes a blade holding rod extending up through the face bar slot and through the blade mounting bolt receiving opening. A blade holding fastener is releasably associated with the blade holding rod. Conveniently, the blade holding rod can be a bolt and the blade holding fastener can be a wing nut.

As shown, the blade clamping means of the blade holder of the invention can also include a releasable blade positioning clamp mounted in the face bar slot. This blade positioning clamp includes a blade positioning bar having at least one flat side; and includes releasable blade positioning bar clamping means to fixedly position that blade positioning bar with respect to the slotted face bar with the flat side of the blade positioning bar in blade positioning contact with the clamped mower blade. The releasable blade positioning clamp can be left in place to provide a means for repositioning the blade for sharpening a second cutting edge portion when the blade holding fastener is disassociated from the blade holding rod so that the blade can be rotated end for end after a first cutting edge portion has been sharpened.

DETAILED DESCRIPTION OF THE PREFERRED EMBODIMENTS

Figure 1:
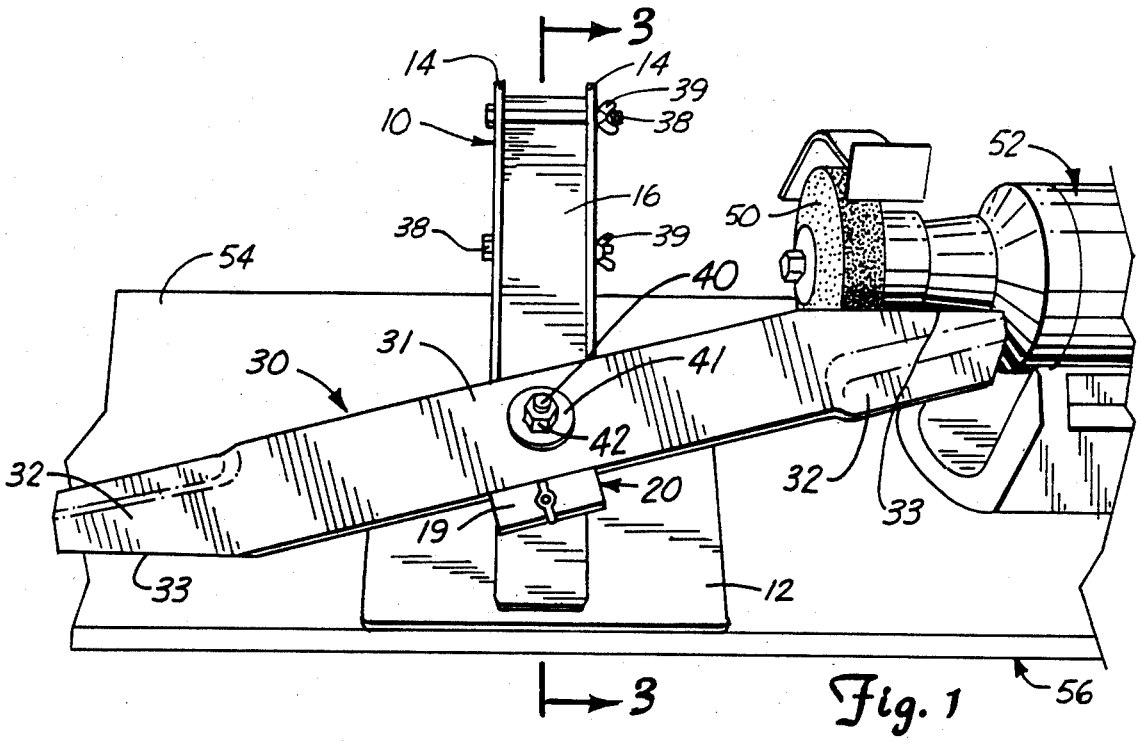
FIG. 1 is a front elevational view of a blade holder of the invention showing its relationship to a lawnmower blade being held in position to be sharpened using a rotary grinder mounted on a flat bench.
Figure 2:
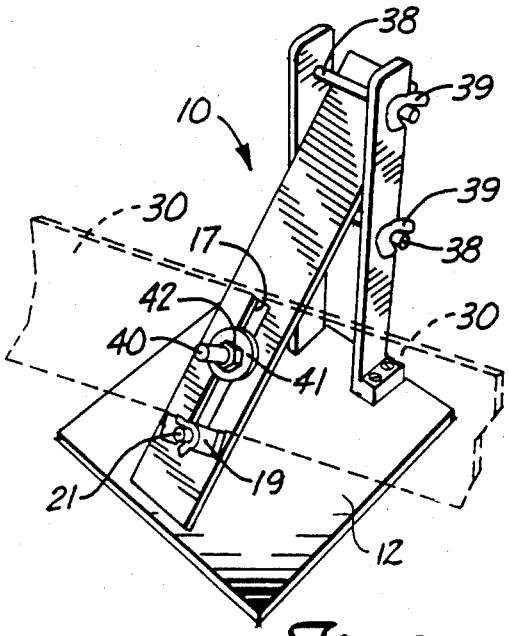
FIG. 2 is a perspective view of the blade holder of FIG. 1 with a central portion of the lawnmower blade shown in phantom.
Figure 3:
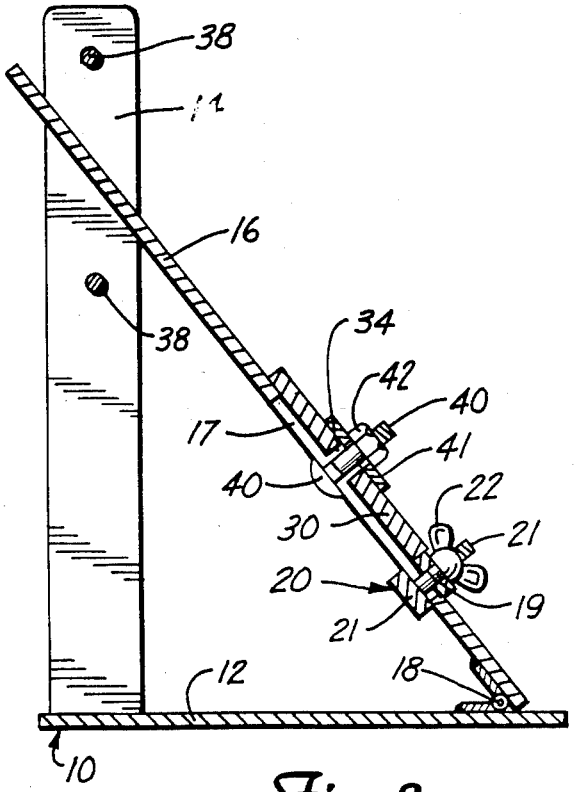
FIG. 3 is an enlarged vertical sectional view taken on the line 3—3 in FIG. 1.

A blade holder 10 includes a base plate 12, support means including mutually parallel, spaced-apart upright legs 14,14 fixedly mounted to and extending perpendicularly upwardly from a rear portion of the base plate, and a slotted face bar 16. The face bar is provided with a longitudinally extending slot 17 and is hinged as at 18 to a forward portion of the base plate 12. A blade positioning bar 19 forms part of a blade positioning clamp 20. The clamp 20 additionally includes a flat-headed bolt 21, and a wing nut 22.

A typical lawnmower blade 30 to be sharpened includes a flat elongate central or intermediate portion 31 and a pair of cutting edge portions 32,32 at opposite ends of the central portion. The cutting edge portions are partially defined by cutting edges 33,33 extending at acute angles with respect to a longitudinal axis of the blade 30. A lawnmower blade mounting bolt receiving opening 34 is provided in the center of the blade.

In order that a rotary lawnmower runs smoothly, these cutting edges 33,33, and cutting edge portions 32,32 should be maintained as nearly as possible in a symmetrical relationship with respect to each other about the center of the bolt opening 34.

With the face bar 16 extending between the upright legs 14,14, means is provided for forcing the legs toward each other to fixedly position the face bar in a desired angular relationship with respect to the base plate 12 over a predetermined angular range of movement of the face bar. In the form of the invention as shown, this fastening means is constituted as a pair of relatively long clamping bolts or rods 38,38, each extending through one of a pair of provided openings in each of the upright legs 14,14; together with a pair of wing nuts or other fasteners 39,39, each threaded onto one of the bolts 38,38. These wing nuts will initially be loose to allow the face bar 16 to be positioned at its desired angle, and will then be tightened to clamp the face bar firmly in such position by forcing the legs 14,14 firmly against it. The bolts 38,38 can be carriage bolts and the blade receiving openings in one upright 14 can be square to receive the shoulders of the carriage bolts.

To position the blade 30 on the blade holder for sharpening, a relatively shorter blade holding carriage bolt or rod 40 extends up through slot 17 of the face bar 16 with its square shoulders in contact with the sides of the slot 17 to prevent rotation of the bolt 40. The opening 34 of the lawnmower blade 30 receives the blade holding carriage bolt 40; and a washer 41 and nut or other fastener 42 are loosely assembled on the bolt. The blade will then be moved up or down the slotted face bar 16 and rotated about the bolt 40 to position a first of the cutting edges 33 to be sharpened in a horizontal plane coincident with or parallel to the axis of rotation of a grinding wheel 50 of a rotary grinder 52 which is fixedly positioned on horizontal upper surface 54 of a work bench 56.

With this first cutting edge 33 so positioned, the blade holding nut 42 and washer 41 will be tightened against the blade. The flat-headed bolt 21 of the blade positioning clamp 20 will be inserted into the slot 17 from below the face bar 16, and through a provided opening in the blade positioning bar 19. This blade positioning bar will be placed flat up against the bottom of the blade 30 and a wing nut 22 of the clamp 20 will be installed on the bolt 21 and tightened to retain the positioning bar in place.

The wing nuts 39,39 will now be loosened sufficiently so that the angle of the face bar can be precisely set so as to predetermine the angle of the outer periphery of the grinding wheel with respect to the first cutting edge 33 to be sharpened. When the proper sharpening angle has been achieved, the wing nuts 39,39 will be tightened to permanently maintain that angle throughout the sharpening of both ends of the blade 30.

To sharpen the first cutting edge 33, with the grinding wheel rotating, the base plate 12 will be moved over the upper surface 54 of the work bench to move the first cutting edge portion 32 along the outer periphery of the grinding wheel to sharpen this first edge 33.

After the first of the cutting edges 33,33 has been sharpened, the base plate 12 of the blade holder 10 is moved away from the grinder. The blade holding nut 42 and washer 41 will be removed from the blade holding bolt 40. The blade 30 will be lifted, rotated 180°, and repositioned on the face bar 16 up against the top edge of the blade positioning bar 19. Bolt 40 will be reinstalled through the slot 17 of the face bar 16 and through the opening 34 in the blade 30. Washer 41 will be reinstalled and nut 42 will again be tightened. This will exactly fixedly position the second cutting edge 33 to lie in the same horizontal plane coincident or parallel with the axis of rotation of grinding wheel 50 as did the first cutting edge, both as seen in FIG. 1. The grinding angle will therefore be the same as that set for sharpening the first cutting edge 33.

To sharpen the second of the cutting edges 33,33, base plate 12 will again be slid over surface 54 of bench 56 to bring the second cutting edge portion 32 in contact with the grinding wheel, and this edge portion will be moved along the grinding wheel to sharpen it by providing a second cutting edge 33 having an identical bevel angle as that of the first cutting edge 33.

Although the present invention has been described with reference to preferred embodiments, workers skilled in the art will recognize that changes may be made in form and detail without departing from the spirit and scope of the invention.

What is claimed is:

1. For use on a flat, horizontal, upper surface of a work station, a device for supporting an elongate blade to be sharpened in a fixed angular position with respect to an abrasive wheel which is rotatably mounted on a horizontal axis in fixed relation with respect to and above said surface of said work station, the device including:

(a) a flat base plate having a flat bottom surface supported on, in contact with, and freely movable with respect to, said horizontal surface of said work station;

(b) an elongate face bar partially defined by an upper, flat, blade-receiving surface, the bar being pivotally mounted at its lower end directly to the base plate to have pivotal movement with respect to that plate about a horizontal axis;

(c) means for clamping an elongate blade to be sharpened against said upper surface of the face bar to have a fixed position relative to the face bar;

(d) support means extending integrally upwardly from the base plate in spaced relation to the point of pivotal connection between the face bar and the base plate; and (e) face bar clamping means operative to selectively clamp an upper portion of the face bar to an upper portion of the support means to achieve a desired fixed angular relationship between the face bar and the base plate.

2. For use on a flat, horizontal, upper surface of a work station, a blade holder for supporting an elongated blade to be sharpened in a fixed angular position with respect to an abrasive wheel which is rotatably mounted on a horizontal axis in fixed parallel relation with respect to and above said surface of said work station, said elongate blade having a relatively flat intermediate portion and at least one cutting edge portion at an end of the intermediate portion, the cutting edge portion being provided with a cutting edge, the blade holder including:

(a) a flat base plate having a flat bottom surface supported on, in contact with, and freely movable with respect to said horizontal surface of said work station;

(b) an elongated face bar partially defined by an upper, flat, blade-receiving surface, the bar being pivotally mounted at its lower end directly to the base plate to have pivotal movement with respect to that plate about a horizontal axis;

(c) blade clamping means for clamping a blade to be sharpened to the upper, blade-receiving surface of the face bar to have the desired final resulting cutting edge of the cutting edge portion of the blade lying in a horizontal plane when the base plate is supported on the horizontal surface of said work station;

(d) support means extending integrally upwardly from the base plate in spaced relation to the point of pivotal connection between the face bar and the base plate; and (e) releasable face bar clamping means operative to selectively clamp an upper portion of the face bar to an upper portion of the support means to achieve a desired angular relationship between the cutting edge portion of a blade to be sharpened and said abrasive wheel as the base plate is moved horizontally over the surface of the work station to bring the rotating abrasive wheel into contact with the cutting edge portion of the elongate blade.

3. For use on a flat, horizontal, upper surface of a work station, a blade holder for supporting an elongate lawnmower blade in a fixed angular position with respect to an abrasive wheel which is rotatably mounted on a horizontal axis in fixed relation with respect to and above said surface of said work station, said lawnmower blade having a relatively flat central portion provided with a mounting bolt receiving opening therethrough and a pair of cutting edge portions at opposite ends of the central portion providing a pair of cutting edges, said cutting edge portions intended to be symmetrical about a center blade axis normal to the flat plane of the central portion of the blade and concentric with the bolt opening through the blade, said blade holder including:

(a) a flat base plate having a flat bottom surface supported on, in contact with, and freely movable with respect to, said horizontal surface of said work station;

(b) an elongate face bar partially defined by an upper, flat, blade-receiving surface, the bar being pivotally mounted at its lower end directly to the base plate to have pivotal movement with respect to that plate about a horizontal axis;

(c) blade clamping means for clamping a center portion of a lawnmower blade to be sharpened to the face bar to have the cutting edge of one of its cutting edge portions lying in a horizontal plane when the base plate is supported on the horizontal surface of the work station;

(d) upright leg means extending upwardly from the base plate in spaced relation to the point of pivotal connection between the face bar and the base plate; and (e) releasable face bar clamping means operative to selectively clamp an upper portion of the face bar to an upper portion of the upright leg means so that a desired cutting edge bevel angle will be attained on the blade cutting edge portion when the blade is clamped to the face bar and when the base plate is moved over the horizontal surface of the work station to bring the outer periphery of the rotating abrasive wheel into contact with said one cutting edge portion.

4. For use on a flat, horizontal, upper surface of a work station, a blade holder for supporting an elongate lawnmower blade to be sharpened in a fixed angular position with respect to an abrasive wheel which is rotatably mounted on a horizontal axis in fixed relation with respect to and above said surface of said work station, said blade having a relatively flat central portion provided with a mounting bolt receiving opening therethrough and a pair of cutting edge portions at each end of the central portion providing a pair of cutting edges, said cutting edge portions intended to be symmetrical about a center blade axis normal to the flat plane of the central portion and concentric with the bolt opening, said blade holder including:

(a) a flat base plate having a flat bottom surface supported on, and contact with, and freely movable with respect to, said horizontal surface of said work station;

(b) a flat, elongate, generally rectangular face bar partially defined by an upper, flat, blade-receiving surface, the bar being pivotally mounted at its lower end directly to the base plate to have pivotal movement with respect to that plate about a horizontal axis so as to locate its blade-receiving surface in any desired acute angular position with respect to the flat bottom surface of the base plate over a predetermined range of angular movement of the face bar;

(c) blade clamping means for clamping a center portion of such a lawnmower blade to be sharpened to the face bar to have the cutting edge of one of its cutting edge portions lying in a horizontal plane when the base plate is supported on the horizontal surface of the work station;

(d) a pair of parallel upright legs extending integrally upwardly from the base plate in spaced relation to the point of pivotal connection between the face bar and the base plate to have position on either side of the face bar througout said predetermined range of angular movement of the face bar, said legs being spaced apart approximately the same distance as the width of the face bar; and (e) releasable face bar clamping means operable on the upright legs to force them into contact with opposite side edges of the face bar to fix the face bar against movement about its horizontal pivot axis when the face bar is supporting the blade so that a desired cutting edge bevel angle will be attained on the cutting edge portion of a blade clamped to the face bar when the base plate is moved over the work service to bring the outer periphery of the abrasive wheel into contact with the one cutting edge portion.

5. The blade holder of claim 3 wherein:

(f) said face bar is provided with a longitudinally extending slot; and (g) said blade clamping means includes a blade holding rod extending up through the face bar slot and the blade mounting bolt receiving opening, and a blade holding fastener releasably associated with the blade holding rod.

6. The blade holder of claim 5 wherein:

(h) the blade clamping means so includes a blade positioning clamp slidably mounted in the face bar slot and having a blade positioning bar with at least one flat side and releasable blade positioning bar clamping means to fixedly position the blade positioning bar with respect to the face bar with its flat side in blade positioning contact with the clamped mower blade, said releasable blade positioning bar clamping means being capable of remaining fixed when the blade holding fastener is disassociated from the blade holding rod to allow the blade to be rotated end for end after a first cutting edge portion has been sharpened.

7. The blade holder of claim 4 wherein:

(f) said face bar is provided with a longitudinally extending slot; and (g) said blade clamping means includes a blade holding bolt extending up through the face bar slot and the blade mounting bolt receiving opening, and a blade holding nut threadably mountable on said bolt.

8. The blade holder of claim 7 wherein:

(h) the blade holding bolt is a carriage bolt having shoulders in rotation preventing relationship to sides of the face bar slot.

9. The blade holder of claim 7 wherein:

(h) the blade clamping means also includes a blade positioning clamp slidably mounted in the face bar slot and having a blade positioning bar with at least one flat side and releasable blade positioning bar clamping means to fixedly position the blade positioning bar with respect to the face bar with the flat side of the positioning bar in blade positioning contact with the clamped mower blade, said blade positioning bar clamping means being capable of remaining fixed when the blade holding nut is disassociated from the blade holding bolt to allow the blade to be rotated end for end after a first cutting edge portion has been sharpened.

10. The blade holder of claim 9 wherein:

(i) the blade positioning bar is provided with a bolt opening therethrough; and (j) the blade positioning bar clamping means includes a bolt extending up through the face bar slot and through the opening in the blade positioning bar and a nut threadably mounted on said bolt.

* * * * *